US009808680B1

(12) United States Patent
Myers et al.

(10) Patent No.: US 9,808,680 B1
(45) Date of Patent: Nov. 7, 2017

(54) PUTTER WITH REPLACEABLE HOSEL

(71) Applicant: Callaway Golf Company, Carlsbad, CA (US)

(72) Inventors: Matthew Myers, Carlsbad, CA (US); James A. Seluga, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 15/414,266

(22) Filed: Jan. 24, 2017

Related U.S. Application Data

(60) Provisional application No. 62/440,325, filed on Dec. 29, 2016.

(51) Int. Cl.
*A63B 53/02* (2015.01)
*A63B 53/04* (2015.01)

(52) U.S. Cl.
CPC ..... *A63B 53/02* (2013.01); *A63B 53/0487* (2013.01)

(58) Field of Classification Search
CPC ..... A63B 53/0487
See application file for complete search history.

(56) References Cited

U.S. PATENT DOCUMENTS 4,881,737 A 11/1989 Mullins
5,407,196 A 4/1995 Busnardo
5,749,790 A * 5/1998 Van Alen, II ..... A63B 53/02 473/245
6,126,555 A * 10/2000 Schooler ..... A63B 53/02 473/248
6,264,571 B1 7/2001 Lekavich
7,442,129 B2 * 10/2008 Bardha ..... A63B 53/0487 473/251
7,566,276 B2 7/2009 Billings
8,753,221 B1 6/2014 Aguinaldo et al.
9,272,193 B1 * 3/2016 Yim ..... A63B 53/02
2014/0187344 A1 * 7/2014 Jones ..... A63B 53/007 473/307

* cited by examiner

*Primary Examiner* — Michael Dennis
(74) *Attorney, Agent, or Firm* — Rebecca Hanovice; Michael Catania; Sonia Lari

(57) ABSTRACT

A putter head comprising a removable and replaceable hosel is disclosed herein. In particular, the putter comprises a first body portion with a plurality of protrusions, a second body portion with a plurality of cavities sized to receive the protrusions, a hosel with an engagement portion that is trapped within one of the cavities by a protrusion, and a mechanical fastener to removably fix each of these pieces together. The fastener preferably extends through a bore on the heel side of the putter head and into a threaded bore within one of the protrusions. In an alternative embodiment, the putter head has a single body portion, which receives the engagement portion of a hosel in a heel side cavity, and which is affixed to the hosel via a fastener that extends through a front surface of the body portion.

15 Claims, 14 Drawing Sheets

PUTTER WITH REPLACEABLE HOSEL

CROSS REFERENCES TO RELATED APPLICATIONS

The present application claims priority to U.S. Provisional Application No. 62/440,325, filed on Dec. 29, 2016, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head, particularly a putter, with a hosel that can be removed and replaced with another hosel having a different style, mass properties, material, and/or bore angle.

Description of the Related Art

The prior art discloses many different types of hosel adjustment features incorporated into golf club heads, and on putters in particular. One example is Billings, U.S. Pat. No. 7,566,276, for Multi-Piece Putter Head Having an Insert. Another example is Lekavich, U.S. Pat. No. 6,264,571, for Dynamically Balanced Modular Putter With a Sliding Hosel. Yet another example is Aguinaldo et al., U.S. Pat. No. 8,753,221, for Adjustable Golf Club Shaft and Hosel Assembly. There still is a need, however, for a well-disguised or hidden putter hosel adjustment system that allows a golfer to change the appearance or orientation of the hosel axis with respect to the putter head's center of gravity.

BRIEF SUMMARY OF THE INVENTION

One aspect of the present invention is a putter comprising a removable hosel. The putter includes a first, main body portion and a second, heel-side body portion, and at least a portion of the removable hosel is trapped within a cavity of the second body portion when the first and second body portions are engaged with one another. A mechanical fastener is used to reversibly fix the pieces of the putter head together.

Another aspect of the present invention is a putter head comprising a first body portion comprising a striking face, a first top surface, a first bottom surface, a first heel side, a first toe side, and first and second protrusions extending from the heel side, a second body portion comprising a front surface, a second top surface, a second bottom surface, a second heel side, a second toe side, first and second cavities extending into the second heel side, a third cavity extending into the second top surface, and a first through-bore extending from the second toe side into the first cavity, a hosel comprising a shaft receiving portion and an engagement portion, and a threaded fastener, wherein the first cavity is sized to receive at least a portion of the first protrusion, wherein the second cavity is sized to receive at least a portion of the second protrusion, wherein the third cavity is in communication with the second cavity (and extends approximately perpendicular to the second cavity), wherein the first protrusion comprises a threaded bore, wherein the first through-bore aligns with the threaded bore when the first protrusion is engaged with the first cavity, wherein the engagement portion is sized to fit within the third cavity, wherein the engagement portion engages at least a portion of the second protrusion, and wherein the threaded fastener reversibly fixes the first body portion to the second body portion to affix the hosel within the third cavity.

In some embodiments, the engagement portion may be selected from the group consisting of a fourth cavity, a hook, and a second through-bore, and preferably is a hook. In other embodiments, the striking face may be flush with the front surface when the first body portion is engaged with the second body portion. In any of the embodiments, the first body portion may comprise a third protrusion extending from the first heel side, and the second body portion may comprise a fifth cavity sized to receive at least a portion of the third protrusion. In a further embodiment, the second protrusion may be disposed proximate the first top surface, and the third protrusion may be disposed proximate the first bottom surface. In other embodiments, the putter head may comprise a seam where the first body portion meets the second body portion, the striking face may comprise at least one vertically oriented scoreline, and the at least one vertically oriented scoreline may be spaced from the seam.

In some embodiments, the engagement portion may comprise a polygonal cross-sectional shape. In a further embodiment, the engagement portion may comprise an octagonal cross-section, and a gap may be maintained between at least one flat side of the octagonal cross section and a wall of the third cavity when the engagement portion is disposed within the third cavity. In yet another, further embodiment, the gap may be no less than 0.0001 inch and no more than 0.0010 inch, and preferably is approximately 0.0005 inch. In any of the embodiments, the engagement portion may have a tapering cross-sectional shape or a cylindrical cross-sectional shape. In other embodiments, each of the first and second protrusions may have a tapering width. In any of the embodiments disclosed herein, the striking face may comprise a plurality of diamond-shaped scorelines and at least one vertically oriented scoreline.

Another aspect of the present invention is directed to a putter head comprising a body portion comprising a front surface, a top surface, a bottom surface, a heel side, a toe side, a rear portion, a heel-side cavity in communication with an upper opening in the top surface, a threaded bore extending from the cavity into the rear portion, and a front bore extending into the cavity from the front surface, a hosel comprising a shaft receiving portion and an engagement portion; and a fastener comprising a head portion and a threaded portion, wherein the engagement portion is sized to fit within the upper opening, wherein the engagement portion comprises a through-bore, wherein the threaded bore is aligned with the front bore, and wherein the threaded portion extends through the front bore and through the through-bore to engage the threaded bore and secure the engagement portion within the heel-side cavity. In some embodiments, the upper opening may have a polygonal cross-sectional shape along an XY plane perpendicular with the front surface. In a further embodiment, the cross-sectional shape may be octagonal. In other embodiments, each of the front bore and the threaded bore may extend perpendicular to the front surface. In still other embodiments, the head portion of the fastener may comprise a shoulder portion, which may abut the engagement portion.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
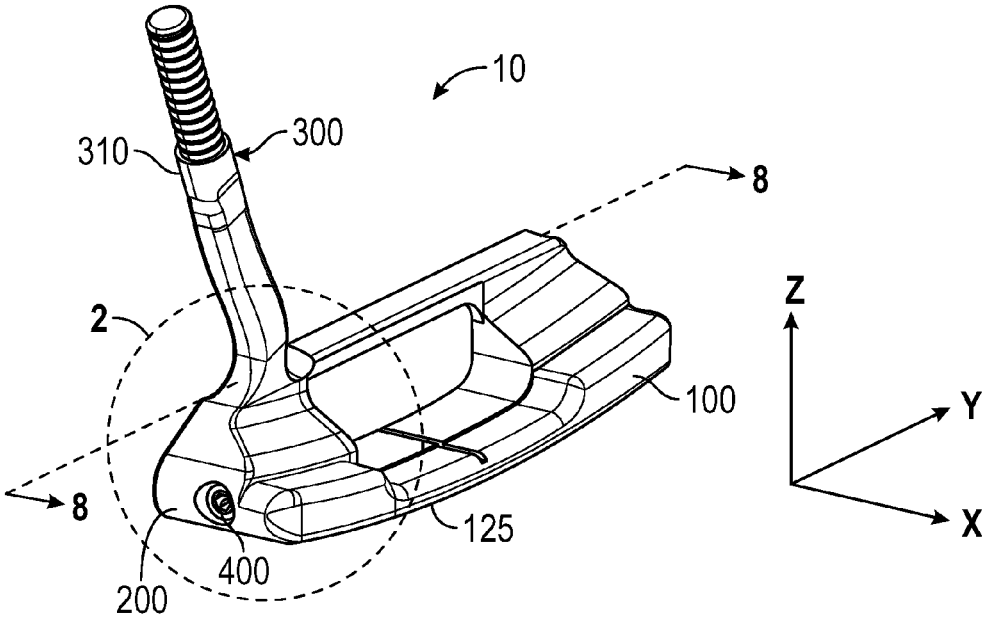
FIG. 1 is a rear perspective view of a first embodiment of the putter head of the present invention engaged with a first hosel.

The present invention is directed to a golf club head, and particularly a putter head, with a removable hosel. In particular, the putter head has first and second body portions that trap a lower portion of the hosel between them and thereby reversibly immobilize the hosel.

In a first embodiment, shown in FIGS. 1-9, the putter head 10 has a first, main body portion 100 with a striking face 110, a top surface 120, a bottom surface 125, a toe side 130, a rear portion 140, and a planar heel side 150 extending approximately perpendicular to the striking face 110. The striking face 110 includes a scoreline pattern 112 that includes at least one, and preferably two, vertical scorelines 114, a plurality of diamond-shaped scorelines 116, and small horizontal scorelines 118 disposed within the diamond-shaped scorelines 116. The heel side 150 includes a plurality of protrusions 160, 165, 170, one protrusion 160 disposed proximate the top surface 120, another, elongated protrusion 165 disposed proximate the bottom surface 125 and extending along a majority of the width of the heel side 150, and a main protrusion 170 disposed between the other two protrusions 160, 165. This configuration is preferred because it helps to ensure complete engagement between parts of the putter head 10 when the putter head 10 is fully assembled. Two of the protrusions 160, 170 have widths that decrease as each protrusion 160, 170 extends away from the heel side 150 of the main body portion 100, such that these protrusions 160, 170 have approximately trapezoidal shapes/are trapezoidal prisms. Each protrusion 160, 165, 170 also extends along a heel-to-toe y-axis that is approximately perpendicular to the heel side 150 of the main body portion 100, which extends along a front-to-back x-axis. The main protrusion 170 includes a threaded bore 180 and preferably has a length that is greater than the lengths of the other protrusions 160, 165.

The putter head 10 also has a second body portion 200 comprising a front surface 210, a top surface 220, a bottom surface 225, a heel side 230, a rear portion 240, and a planar toe side 250 extending approximately perpendicular to the front surface 210. The toe side 250 includes a main cavity 270 sized to receive the main protrusion 170 and a plurality of smaller cavities 260, 265, one cavity 260 sized to receive the uppermost protrusion 160, the other sized to receive the lowermost protrusion 165. A through bore 280 with an abutment surface 282 extends through the toe side 250 and communicates with the main cavity 270; when the main protrusion 170 is fully engaged with the main cavity 270, the through-bore 280 aligns with the threaded bore 180 such that the threaded portion 410 of a mechanical fastener 400 can extend into the through-bore 280 and engage the threads of the threaded bore 180, while the head portion 420 of the fastener 400 abuts the abutment surface 282. The top surface 220 also includes a hosel-receiving cavity 290, which intersects and communicates with the upper cavity 260, such that the two cavities 260, 290 are oriented approximately perpendicular to one another.

Figure 11:
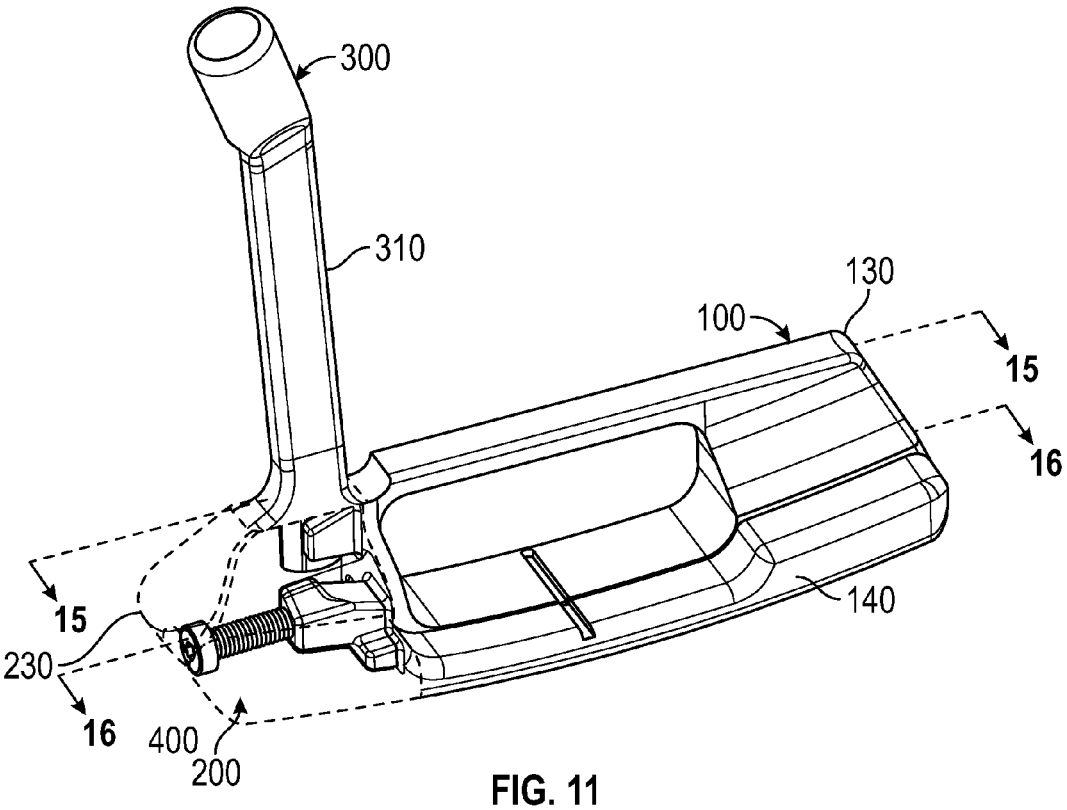
FIG. 11 is a rear elevational, partially transparent view of the putter head shown in FIG. 10 engaged with a fifth hosel.
Figure 12:
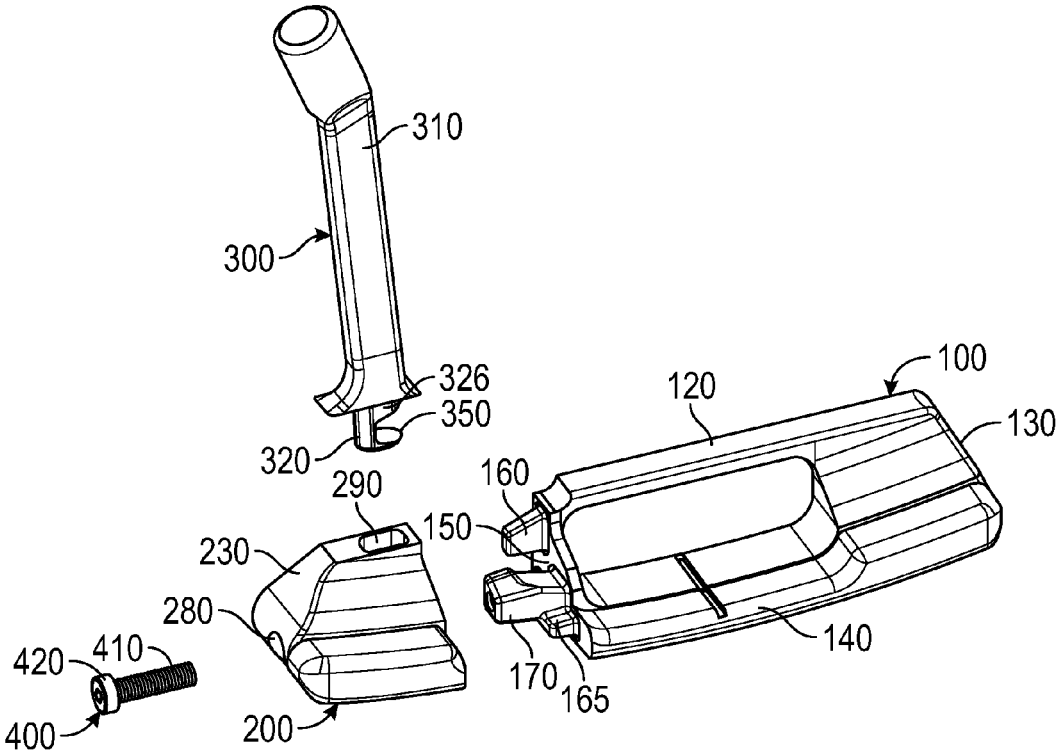
FIG. 12 is a top perspective, exploded view of the putter head and hosel shown in FIG. 11.
Figure 13:
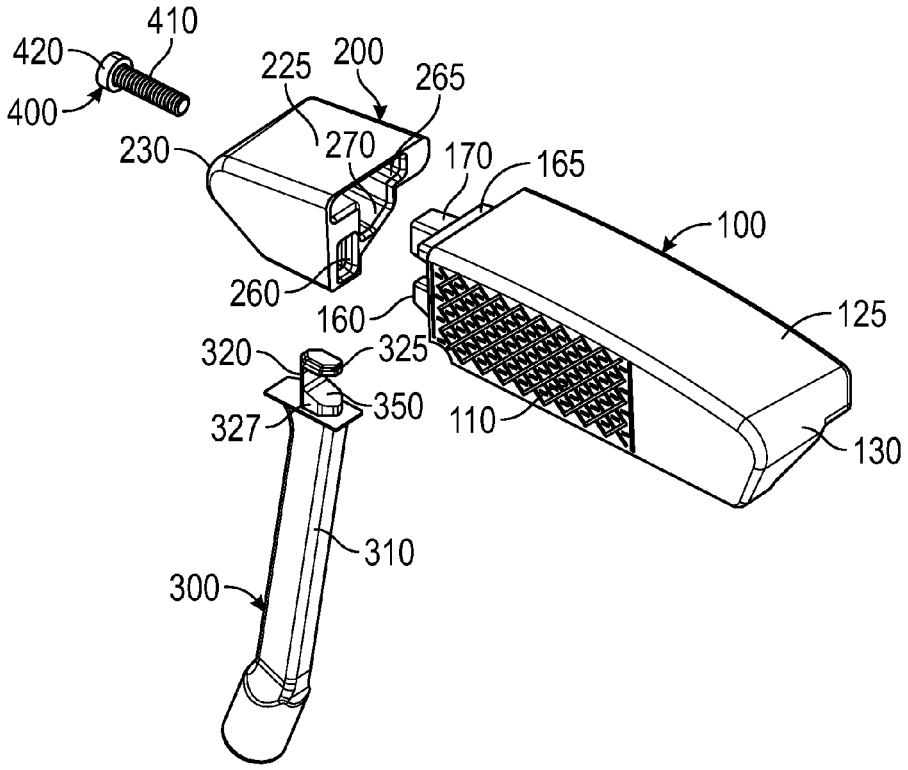
FIG. 13 is a bottom perspective view of the putter head and hosel shown in FIG. 12.

The putter head 10 shown in FIGS. 1-9 also includes a hosel 300, which has a shaft-receiving portion 310 that is visible to a user when the putter head 10 is fully assembled, and a lower engagement portion 320 that is obscured by the first and second body portions 100, 200 when the putter head 10 is fully assembled. The shaft-receiving portion 310 may be any shape preferred by the golfer or known in the art; for example, the hosel 300 shown in FIGS. 1-6, 10, 17, and 21 has a gradually angled shaft-receiving portion 310, the shaft-receiving portion 310 in FIGS. 7-9 has a crank-neck bend towards the front surface 210, and the shaft-receiving portion 310 in FIGS. 11-13 has a sharp bend towards the heel side 230.

Figure 2:
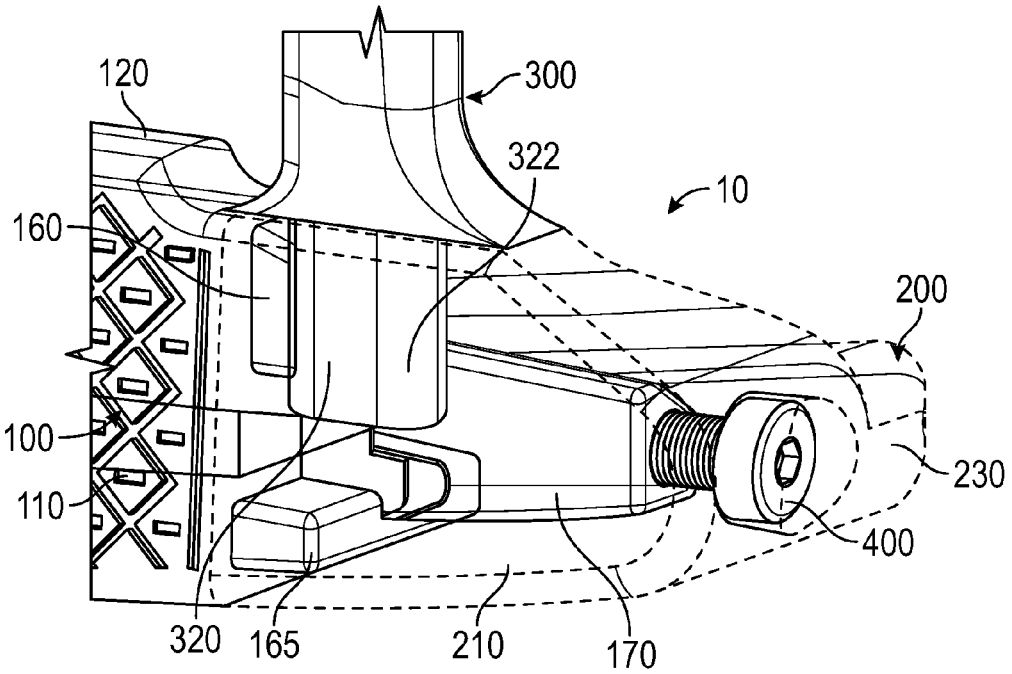
FIG. 2 is a front, partially transparent view of the circled portion of the putter head and hosel shown in FIG. 1.
Figure 3:
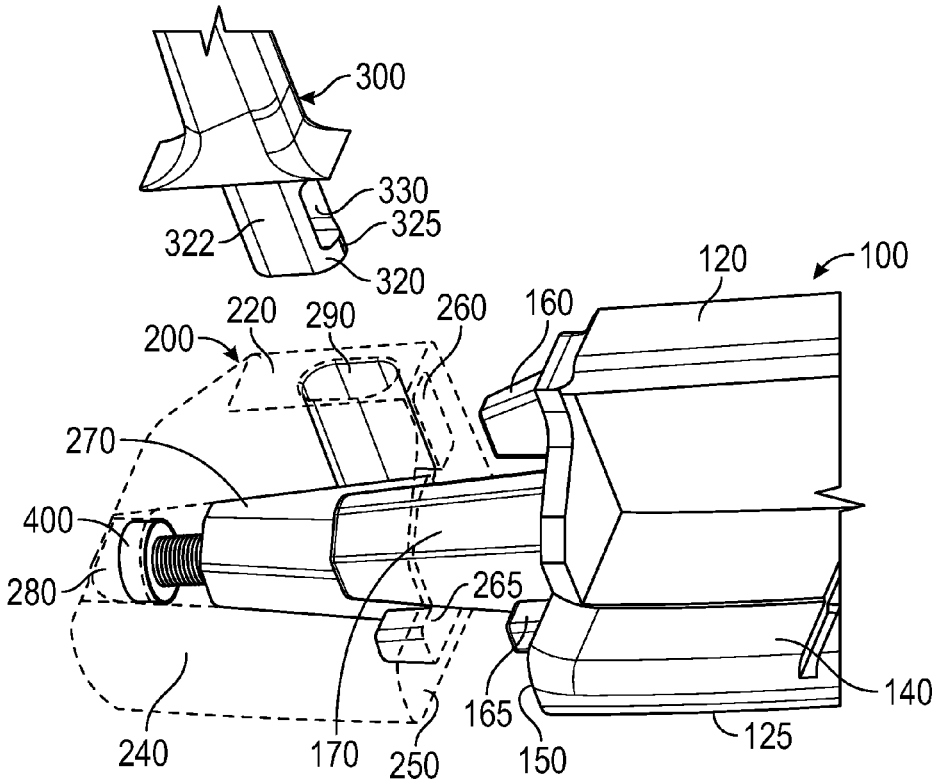
FIG. 3 is a rear elevational, exploded view of the portion of the putter head shown in FIG. 2.
Figure 4:
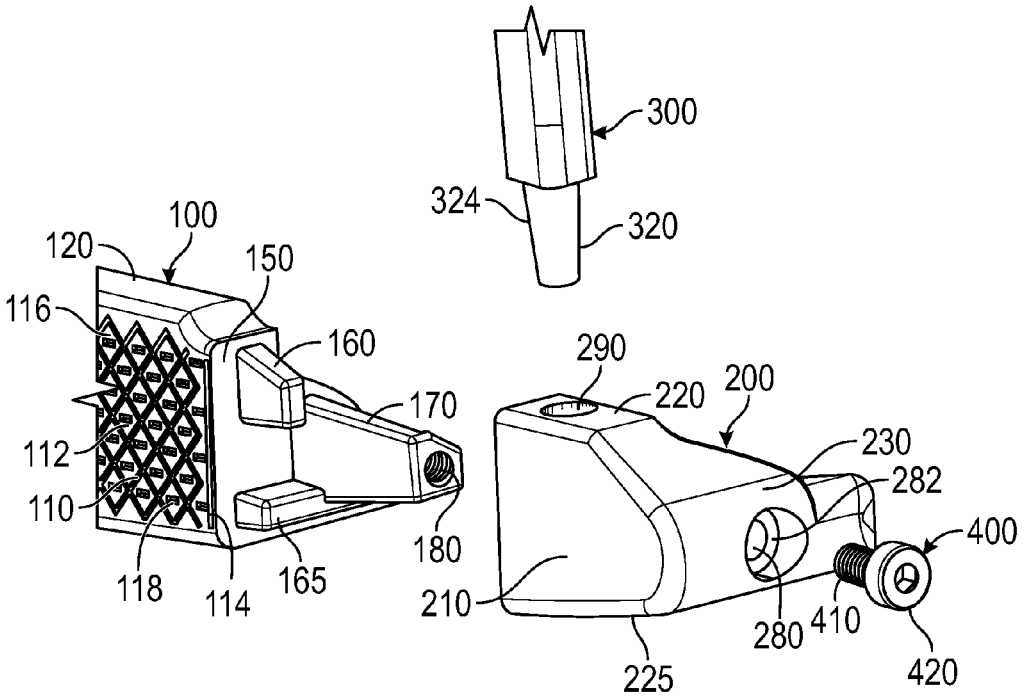
FIG. 4 is a front, exploded view of the portion of the putter head shown in FIG. 2 engaged with a second hosel.
Figure 5:
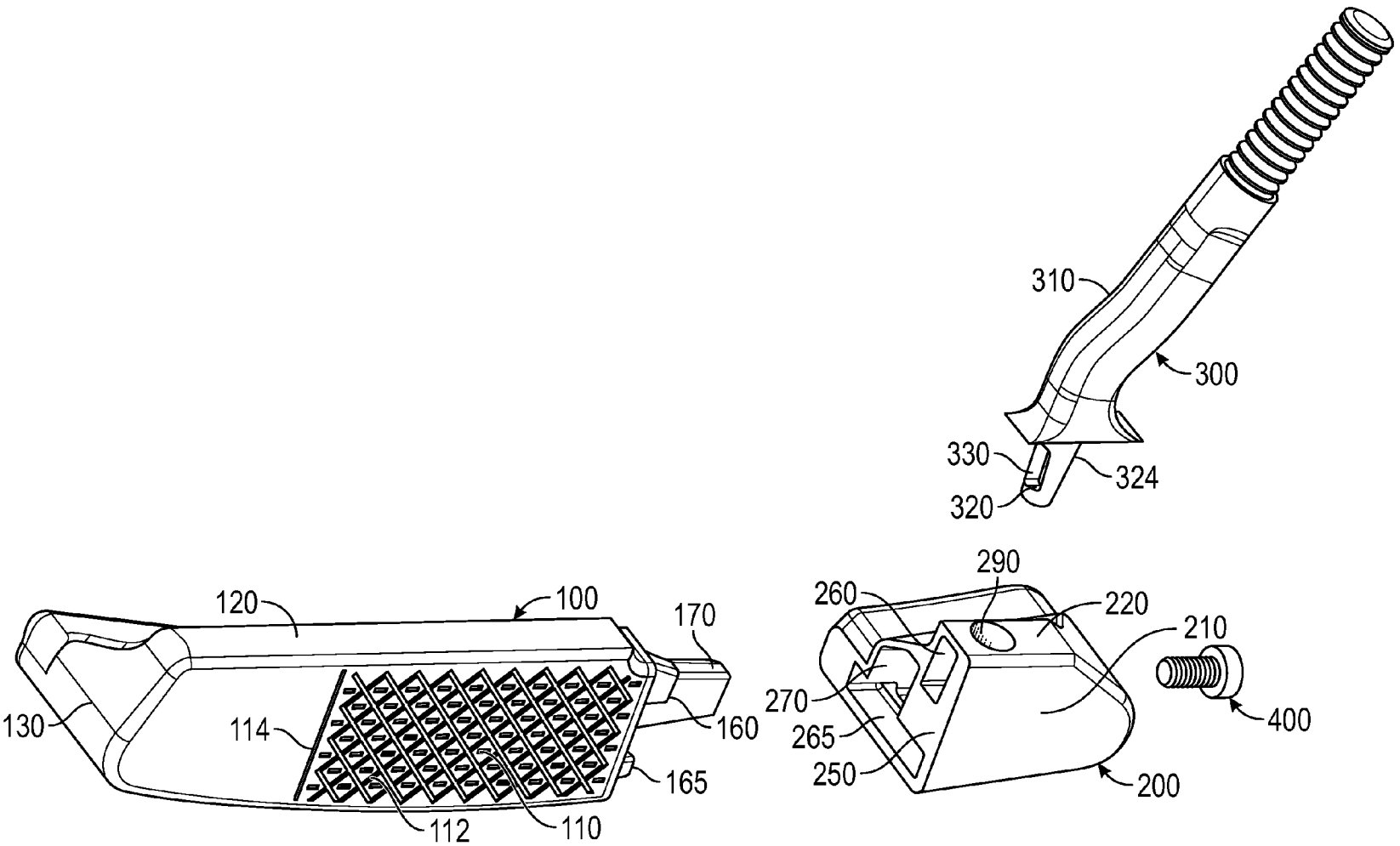
FIG. 5 is a top elevational, exploded view of the putter head and hosel shown in FIG. 4.
Figure 6:
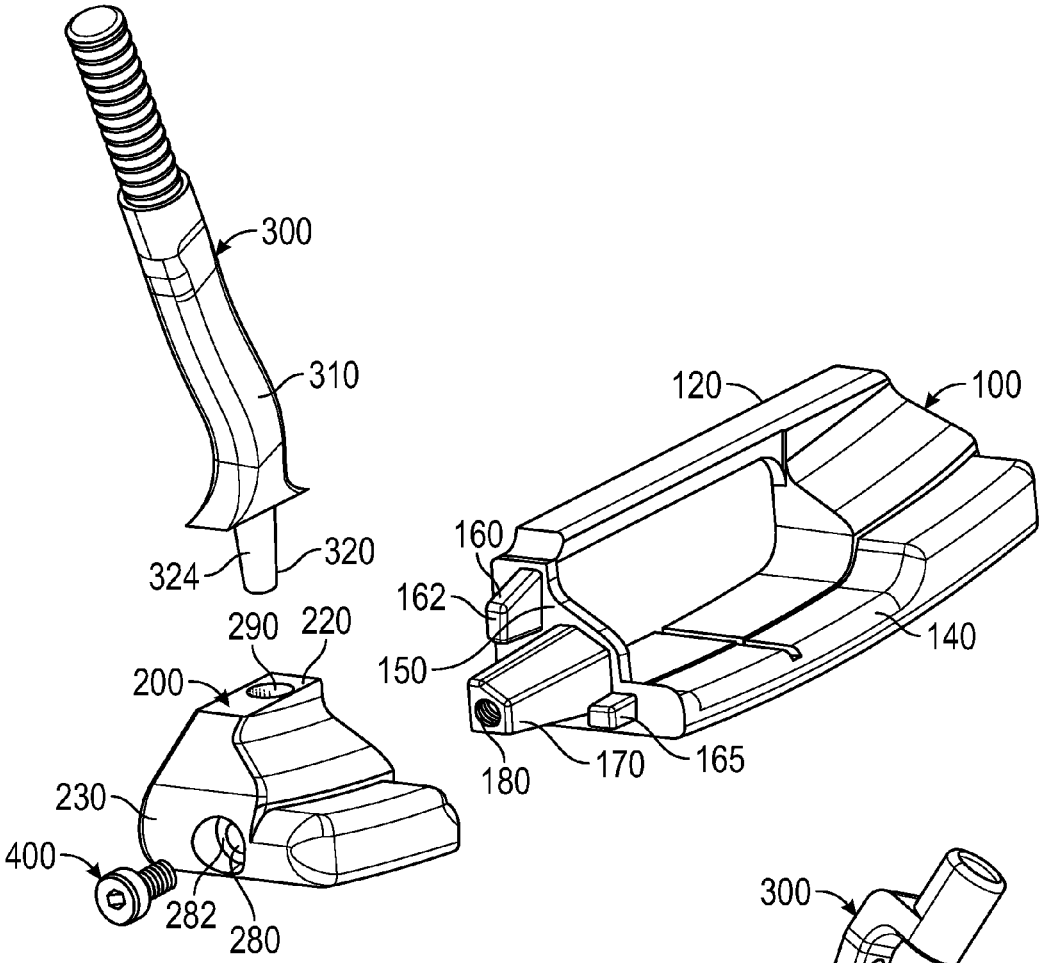
FIG. 6 is a rear perspective view of the putter head shown in FIG. 5.
Figure 7:
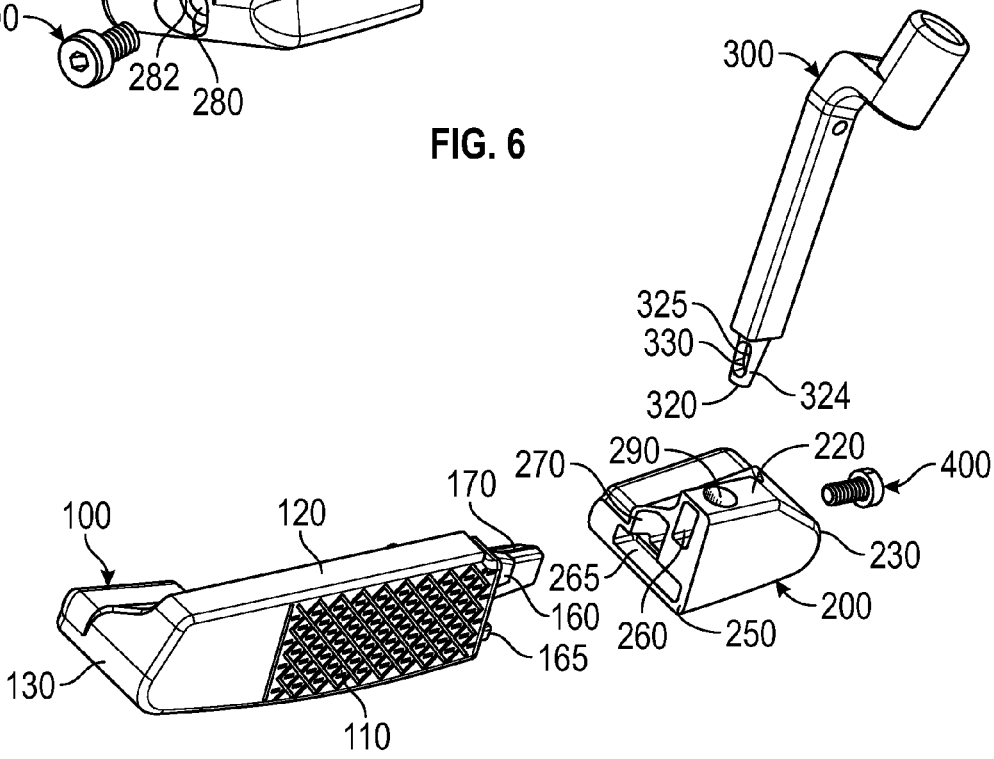
FIG. 7 is a top perspective view of the putter head shown in FIG. 5 engaged with a third hosel.
Figure 8:
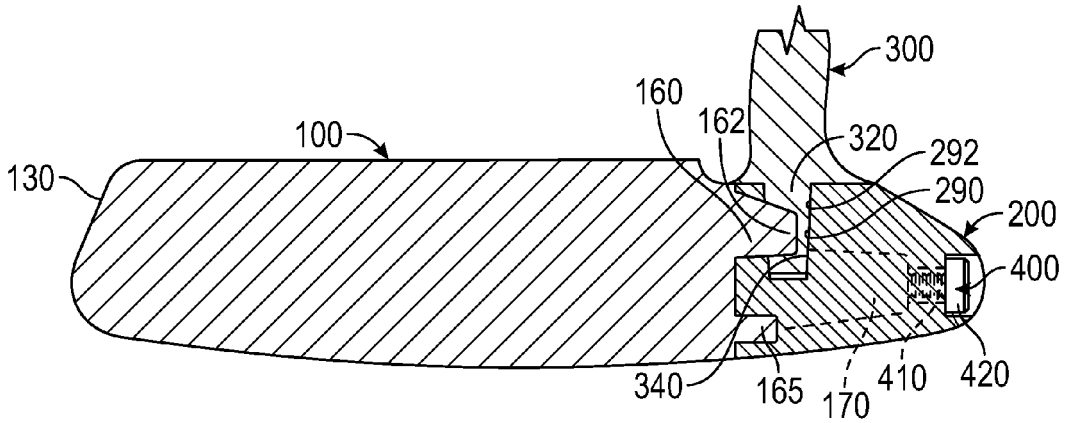
FIG. 8 is a cross-sectional view of the putter head shown in FIG. 1 along lines 8-8 when engaged with the third hosel.
Figure 9:
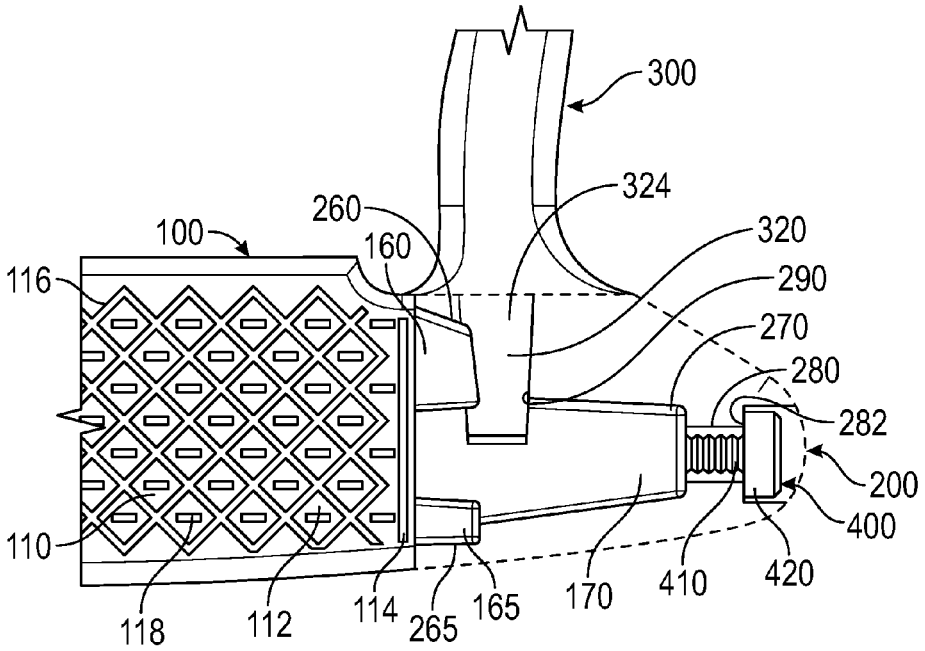
FIG. 9 is a front elevational, partially transparent view of the putter head shown in FIG. 1 when engaged with the third hosel.
Figure 10:
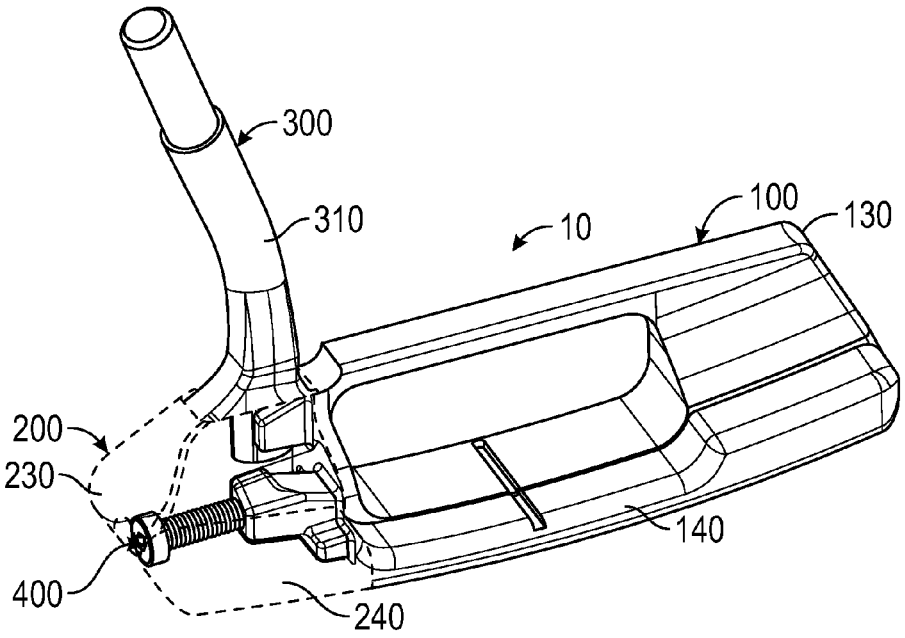
FIG. 10 is a rear elevational, partially transparent view of a second embodiment of the putter head of the present invention engaged with a fourth hosel.

The hosel 300 shown in FIGS. 1-3 has an engagement portion 320 with an approximately cylindrical cross-sectional shape 322, while the hosel 300 shown in FIGS. 4-9 has an engagement portion 320 with a tapered shape 324 to orient and center the engagement portion 320 within the hosel-receiving cavity 290. In any event, as shown in each of these Figures, the hosel-receiving cavity 290 is shaped and sized to securely receive the engagement portion 320 of the hosel 300. Each of these engagement portions 320 has an opening 330 extending only into a front wall 325 of the engagement portion 320. When the engagement portion 320 is fully inserted into the hosel-receiving cavity 290 so that the opening 330 is facing the toe side 250, the first body portion 100 can be engaged with the second body portion 200 by inserting each of the protrusions 160, 165, 170 into their corresponding cavities 260, 265, 270 in the second body portion 200. As shown in FIG. 8, this causes the tip 162 of the uppermost protrusion 160 to enter the opening 330 and press the rear wall 340 of the engagement portion 320 against the rear wall 292 of the cavity 290. When the protrusions 160, 165, 170 are fully engaged with their corresponding cavities 260, 265, 270, the mechanical fastener 400 is inserted into the through bore 280 and screwed into the threaded bore 180 of the main protrusion 170 using a tool such as a screwdriver or torque wrench. Tightening the fastener 400 reversibly fixes the first and second body portions 100, 200 together and traps and immobilizes the engagement portion 320 of the hosel 300 between them.

Figure 14:
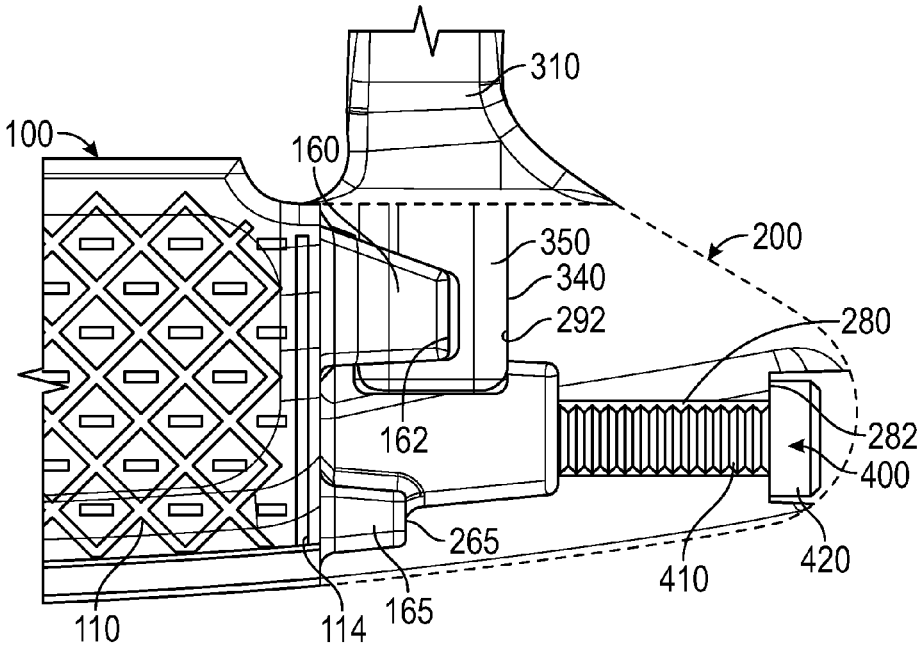
FIG. 14 is a front elevational, partially transparent view of the putter head and hosel shown in FIG. 11.
Figure 15:
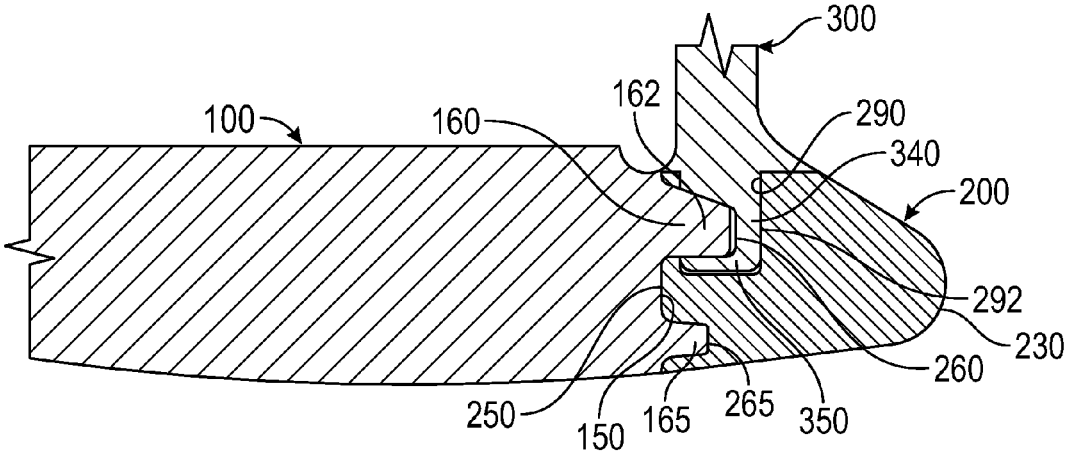
FIG. 15 is a cross-sectional view of the putter head and hosel shown in FIG. 11 along lines 15-15.
Figure 16:
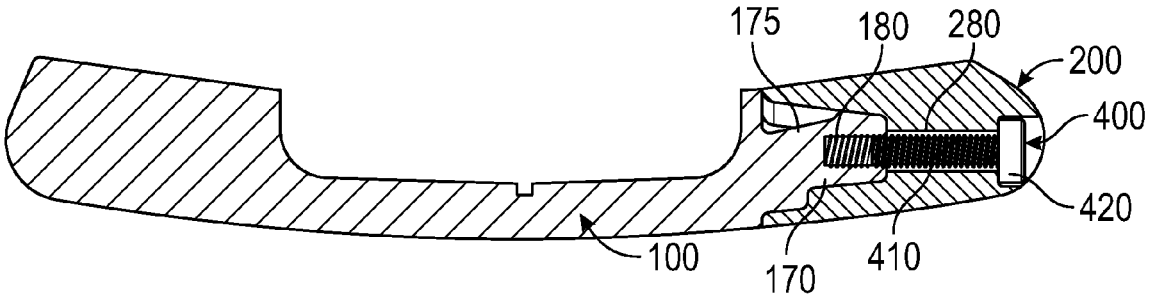
FIG. 16 is a cross-sectional view of the putter head and hosel shown in FIG. 11 along lines 16-16.

A second, preferred embodiment of the present invention is shown in FIGS. 10-21. The putter head 10 shown in these Figures has all of the same basic features as the first embodiment, except that the main protrusion 170 has a hooked portion 175 that can engage a structure in the second body portion 200, such as a wall 292 defining the hosel-receiving cavity 290, and the lower engagement portion 320 of the hosel is a hook 350, with openings in the front and side walls 325, 326, 327. As with the first embodiment, when the engagement portion 320 is fully inserted into the hosel-receiving cavity 290 so that the hook 350 is facing the toe side 250, the first body portion 100 can be engaged with the second body portion 200 by inserting each of the protrusions 160, 165, 170 into their corresponding cavities 260, 265, 270 in the second body portion 200. As shown in FIGS. 14 and 15, this causes the tip 162 of the uppermost protrusion 160 to enter the hook 350 and press the rear wall 340 of the engagement portion 320 against the rear wall 292 of the cavity 290. Then, as shown in FIG. 16, the threaded portion 410 of the mechanical fastener 400 is inserted into the through bore 280 and screwed into the threaded bore 180 of the main protrusion 170 using a tool such as a screwdriver or torque wrench. Tightening the fastener 400 reversibly fixes the first and second body portions 100, 200 together and traps and immobilizes the engagement portion 320 of the hosel 300 between them.

Figure 17:
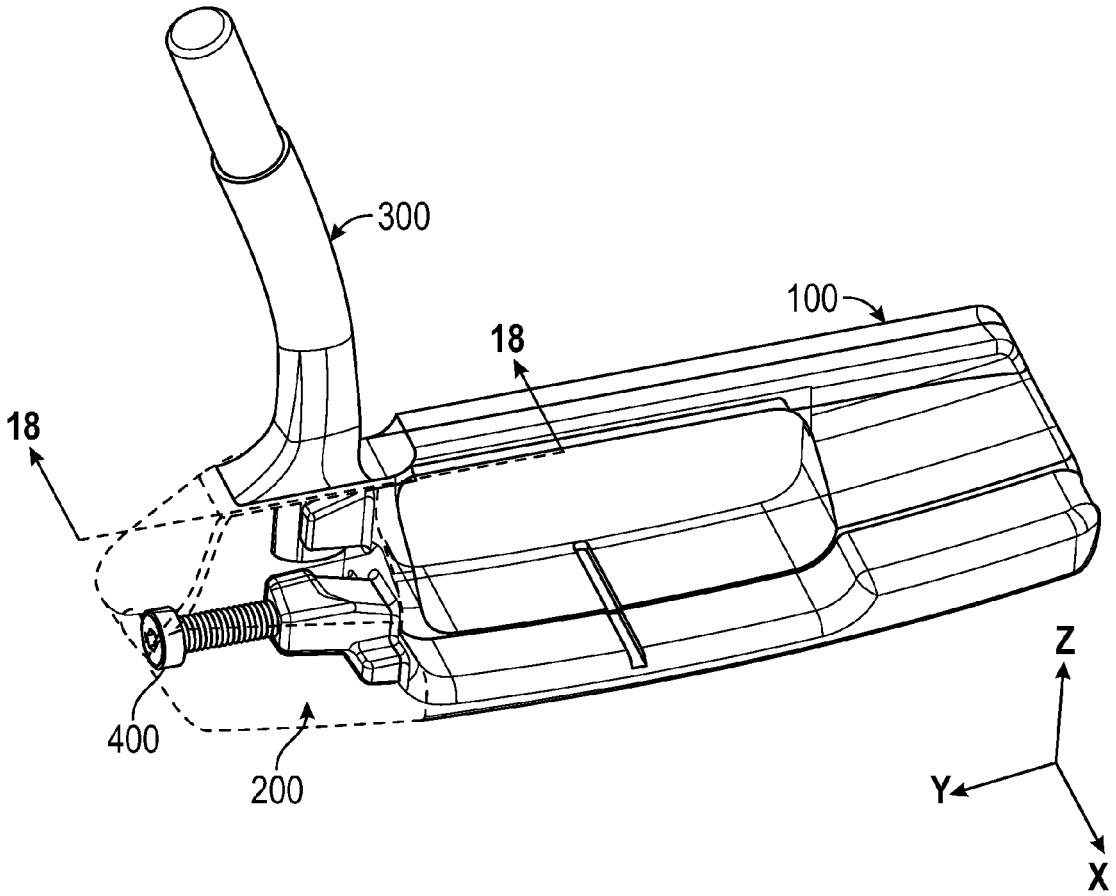
FIG. 17 is a wire-frame view of the putter head and hosel shown in FIG. 10.
Figure 18:
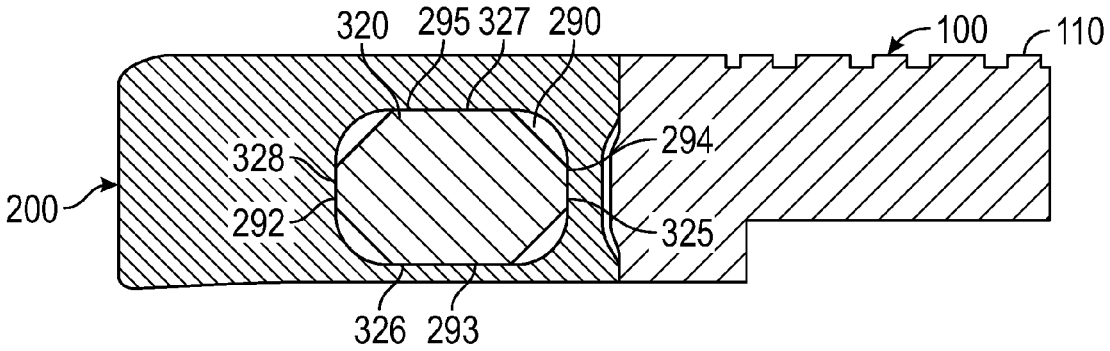
FIG. 18 is a cross-sectional view of the putter head and hosel shown in FIG. 17 along lines 18-18.

The lower engagement portion 320 of the preferred embodiment has a polygonal cross-sectional shape along an x-y plane, as shown in FIGS. 17-18. In particular, the cross-section is octagonal, with minimal spacing between the side walls 325, 326, 327, 328 of the engagement portion 320 and the flat side walls 292, 293, 294, 295 (i.e., not the corners) of the hosel-receiving cavity 290. Preferably, the spacing ranges from 0.0001-0.0010 inch, and more preferably the spacing is approximately 0.0005 inch.

Figure 19:
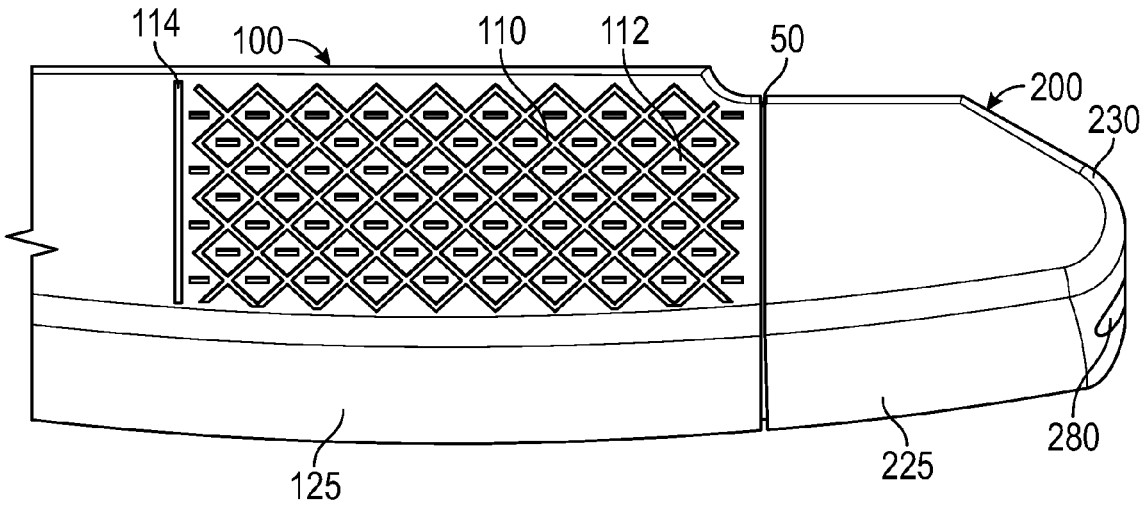
FIGS. 19-20 are front, elevational views of the putter head and hosel shown in FIG. 10.
Figure 20:
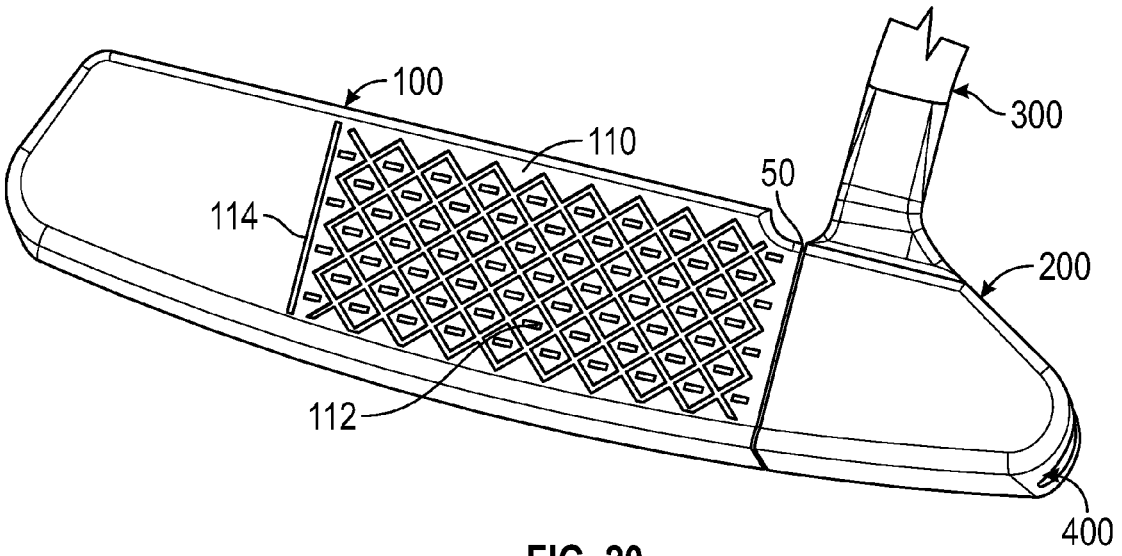
Figure 21:
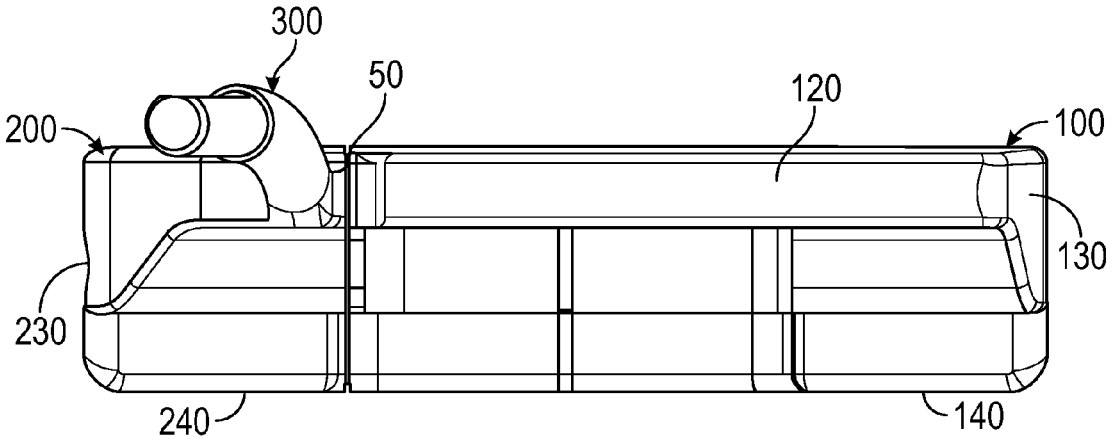
FIG. 21 is a top elevational view of the putter head and hosel shown in FIG. 10.
Figure 22:
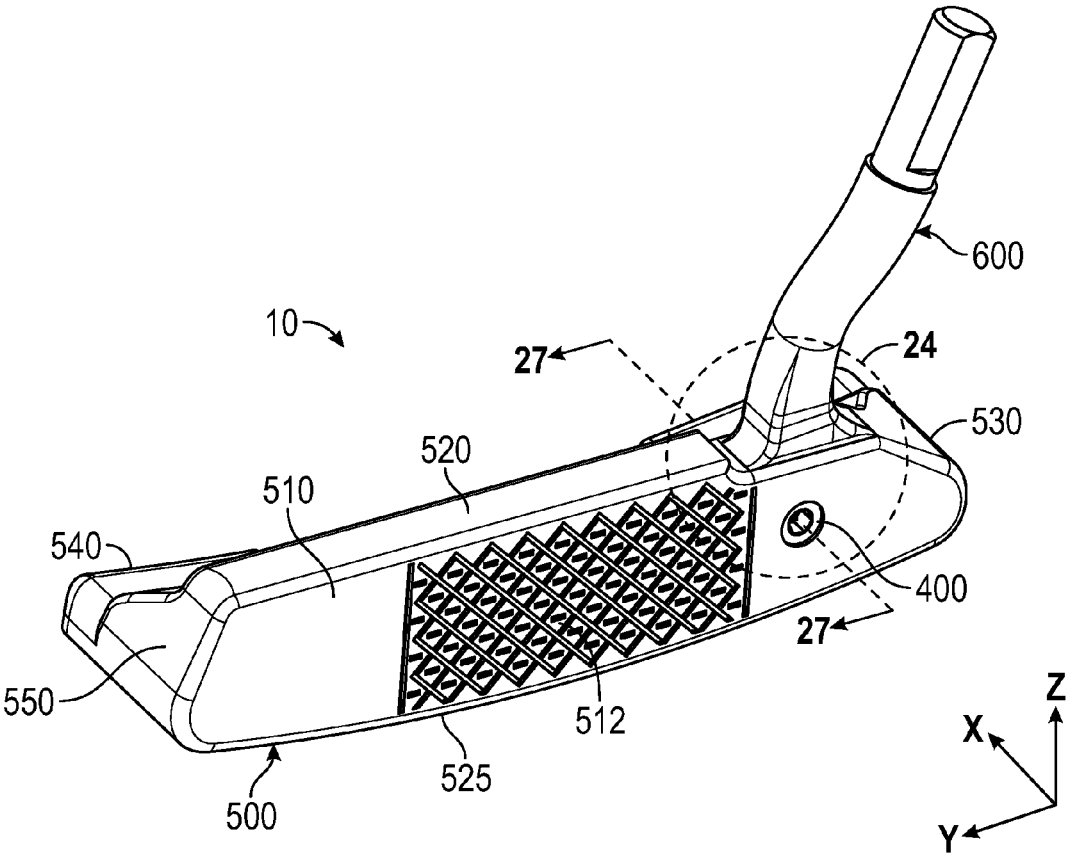
FIG. 22 is a front perspective view of a third embodiment of the putter head of the present invention.
Figure 23:
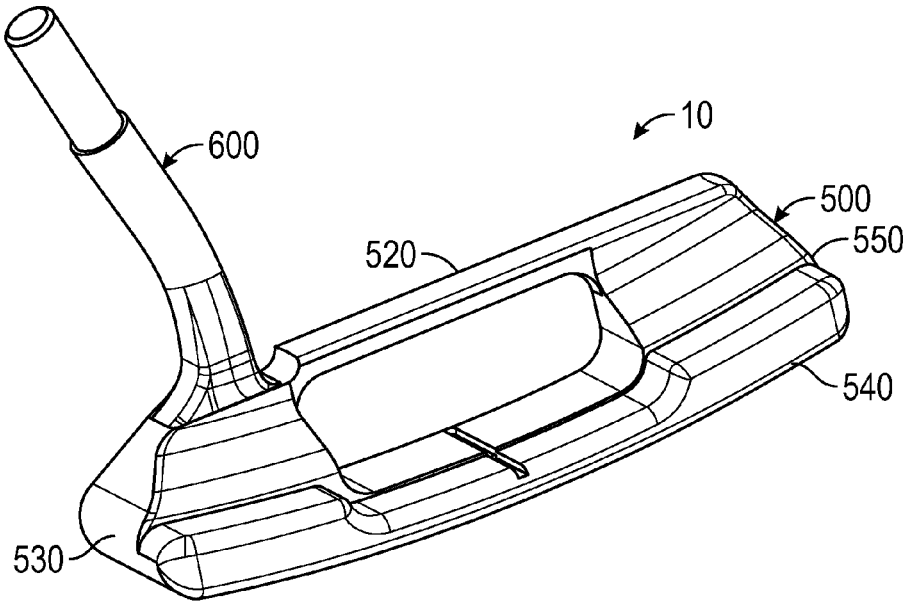
FIG. 23 is a rear perspective view of the embodiment shown in FIG. 22.
Figure 24:
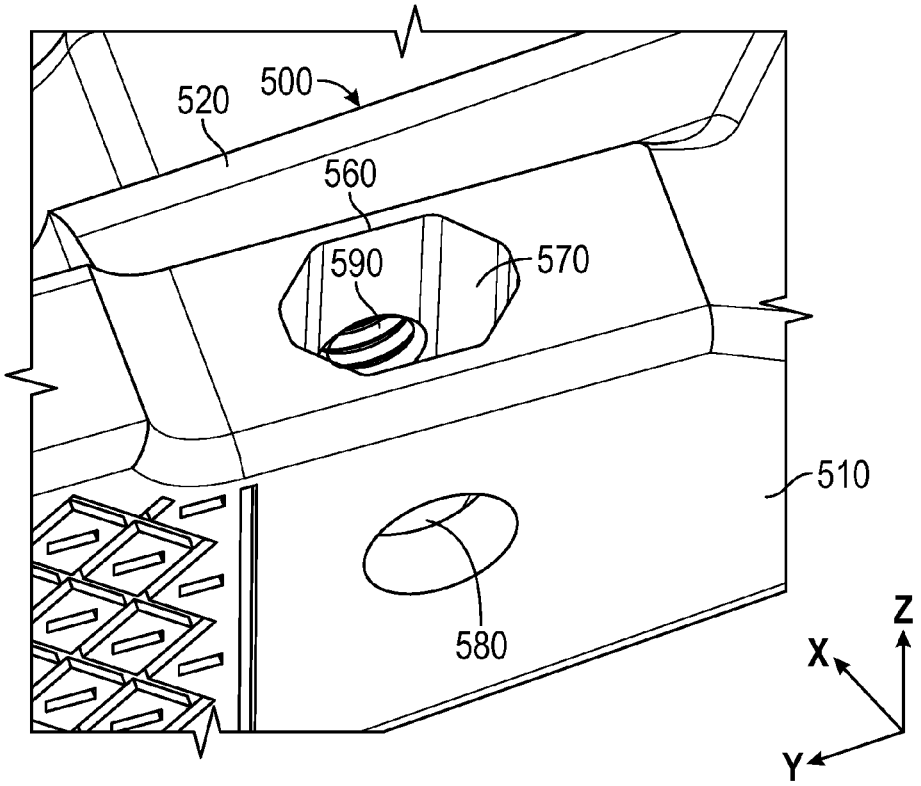
FIG. 24 is an enlarged view of the circled portion of the embodiment shown in FIG. 22 with the hosel removed.
Figure 25:
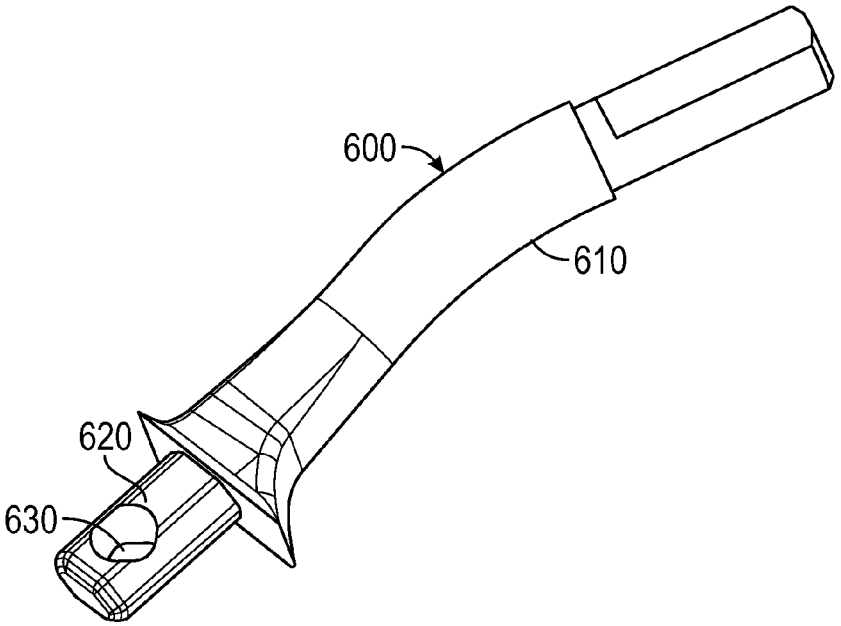
FIG. 25 is a top elevational view of the hosel shown in FIG. 22.
Figure 26:
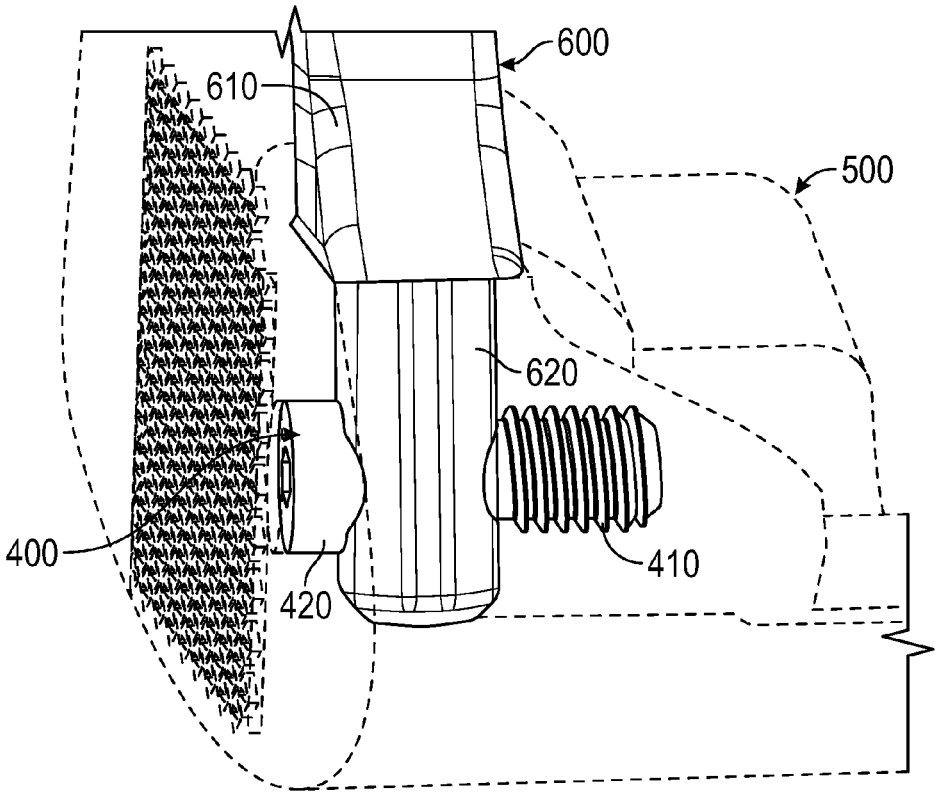
FIG. 26 is a heel side, partially transparent view of the embodiment shown in FIG. 22
Figure 27:
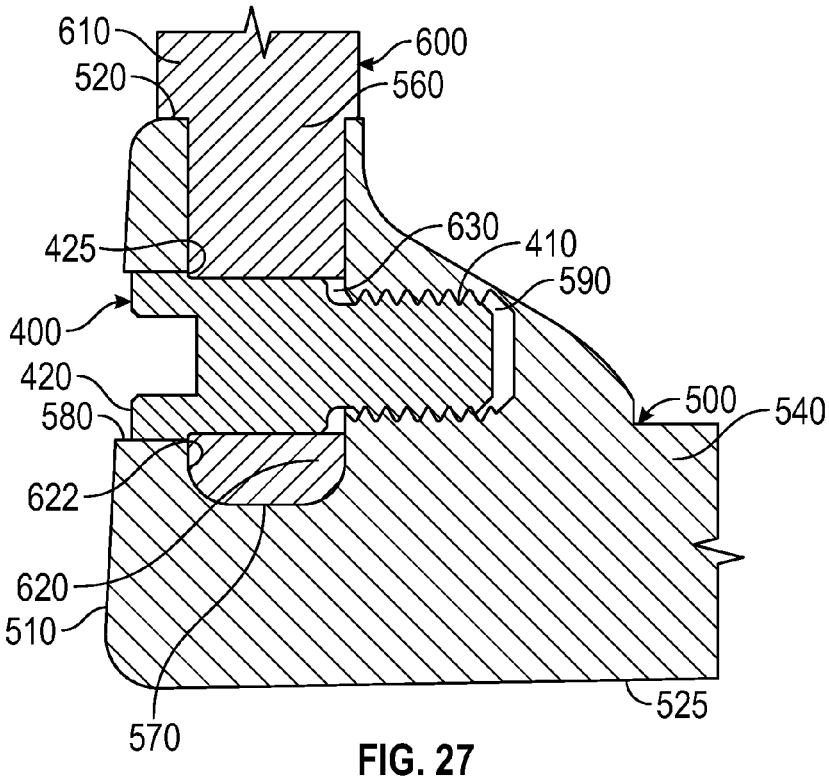
FIG. 27 is a cross-sectional view of the embodiment shown in FIG. 22 along lines 27-27.

In any of the embodiments disclosed above, the seam 50 created by the first and second body portions 100, 200 where they meet each other can be disguised by incorporating it into the scoreline pattern 112 on the striking face 110. As shown in FIGS. 19-21, the seam 50, which extends around the circumference of the putter head 10, appears to be one of the vertical scorelines 114 and thus is less noticeable to a golfer. In these embodiments, the striking face 110 is flush with the front surface 210 when the first and second body portions 100, 200 are attached to one another.

In another embodiment of the present invention, shown in FIGS. 22-27, the putter head 10 has only one body portion 500, to which a removable hosel 600 is affixed with a mechanical fastener 400 through the front surface 510 of the body 500. The body portion 500 comprises a scoreline pattern 512 on the front surface 510, a top surface 520, a bottom surface 525, a heel side 530, a rear portion 540, a toe side 550, and an upper opening 560 in communication with a cavity 570 disposed within the heel side 530 of the body 500. A front bore 580 extends into the cavity 570 from the front surface 510 and is aligned along a front-to-back x-axis with a threaded bore 590 that extends from the cavity 570 into the rear portion 540 of the body 500, preferably without extending all the way through the body 500. The cavity 570 has a polygonal (preferably octagonal) cross-section along an XY plane, and is sized to receive the engagement portion 620 of the removable hosel 600, which has a mating, polygonal (preferably octagonal) cross-section and a through-bore 630. The hosel 600 also includes a shaft-receiving portion 610, which may have any of the features of the other embodiments disclosed herein.

The hosel 600 of this embodiment can be reversibly affixed to the body 500 by inserting the engagement portion 620 into the cavity 570 so that the through-bore 630 is aligned with the front bore 580 and the threaded bore 590, and then inserting the threaded portion 510 of the mechanical fastener into the front bore 580, through-bore 630, and threaded bore 590 so that the threads of the threaded portion 510 engage with the threads of the threaded bore 590. The mechanical fastener 400 includes a head portion 420 with a shoulder 425 that abuts an outer surface 622 of the engagement portion 620 when the fastener 400 is fully engaged with the body 500, further securing the engagement portion 620, and thus the hosel 600, in place with respect to the body 500.

The cavity 570 preferably is disposed entirely in the heel side 530 of the body 500, such that the scorelines 512 are located toe-wards of the cavity 570 on the body 500.

Each piece of the putter head 10 preferably is composed of a high strength material such as titanium alloy or stainless steel. Alternatively, portions of the putter head 10, such as the hosel 30, can be formed of a lighter weight material such as aluminum ally, carbon composite, or plastic to reduce the overall weight of the putter head 10 and ensure a low center of gravity. The material composition of the different parts of the putter head 10 can, however, be adjusted as desired by the golfer to change the center of gravity location.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A putter head comprising:

a first body portion comprising a striking face, a first top surface, a first bottom surface, a first heel side, a first toe side, and first and second protrusions extending from the heel side;

a second body portion comprising a front surface, a second top surface, a second bottom surface, a second heel side, a second toe side, first and second cavities extending into the second heel side, a third cavity extending into the second top surface, and a first through-bore extending from the second toe side into the first cavity;

a hosel comprising a shaft receiving portion and an engagement portion; and a threaded fastener, wherein the first cavity is sized to receive at least a portion of the first protrusion, wherein the second cavity is sized to receive at least a portion of the second protrusion, wherein the third cavity is in communication with the second cavity, wherein the first protrusion comprises a threaded bore, wherein the first through-bore aligns with the threaded bore when the first protrusion is engaged with the first cavity, wherein the engagement portion is sized to fit within the third cavity, wherein the engagement portion engages at least a portion of the second protrusion, and wherein the threaded fastener reversibly fixes the first body portion to the second body portion to affix the hosel within the third cavity.

2. The putter head of claim 1, wherein the engagement portion is selected from the group consisting of a fourth cavity, a hook, and a second through-bore.

3. The putter head of claim 2, wherein the engagement portion is a hook.

4. The putter head of claim 1, wherein the striking face is flush with the front surface when the first body portion is engaged with the second body portion.

5. The putter head of claim 1, wherein the first body portion comprises a third protrusion extending from the first heel side, and wherein the second body portion comprises a fifth cavity sized to receive at least a portion of the third protrusion.

6. The putter head of claim 5, wherein the second protrusion is disposed proximate the first top surface, and wherein the third protrusion is disposed proximate the first bottom surface.

7. The putter head of claim 1, further comprising a seam where the first body portion meets the second body portion, wherein the striking face comprises at least one vertically oriented scoreline, and wherein the at least one vertically oriented scoreline is spaced from the seam.

8. The putter head of claim 1, wherein the engagement portion comprises a polygonal cross-sectional shape.

9. The putter head of claim 8, wherein the engagement portion comprises an octagonal cross-section, and wherein a gap is maintained between at least one flat side of the octagonal cross section and a wall of the third cavity when the engagement portion is disposed within the third cavity.

10. The putter head of claim 9, wherein the gap is no less than 0.0001 inch and no more than 0.0010 inch.

11. The putter head of claim 1, wherein the engagement portion has a tapering cross-sectionalshape.

12. The putter head of claim 1, wherein the engagement portion has a cylindrical cross-sectional shape.

13. The putter head of claim 1, wherein each of the first and second protrusions has a tapering width.

14. The putter head of claim 1, wherein the striking face comprises a plurality of diamond-shaped scorelines and at least one vertically oriented scoreline.

15. The putter head of claim 1, wherein the second cavity and the third cavity extend approximately perpendicular to one another.

* * * * *